United States Patent [19]

Gibson

[11] Patent Number: 4,709,923

[45] Date of Patent: Dec. 1, 1987

[54] PORTABLE EXERCISE MACHINE

[76] Inventor: Christopher S. Gibson, 403 St. Ronan St., New Haven, Conn. 06511

[21] Appl. No.: 922,077

[22] Filed: Oct. 20, 1986

Related U.S. Application Data

[63] Continuation-in-part of Ser. No. 669,680, Nov. 9, 1984, Pat. No. 4,618,144.

[51] Int. Cl.[4] ..... A63B 21/00

[52] U.S. Cl. ..... 272/134; 272/144

[58] Field of Search ..... 272/144, 134, 136

[56] References Cited

U.S. PATENT DOCUMENTS

| | | | |
|---|---|---|---|
| 2,261,173 | 11/1941 | Maxwell | 272/136 |
| 2,651,353 | 9/1953 | McWain et al. | 108/115 |
| 2,739,859 | 3/1956 | Cohen | 108/115 |
| 3,524,644 | 8/1970 | Kane | 272/134 |
| 3,558,131 | 1/1971 | Dragon | 272/134 |
| 3,598,405 | 9/1971 | Burns | 272/58 |
| 3,664,666 | 5/1972 | Lloyd | 272/136 |
| 3,817,243 | 6/1974 | Perrine | 128/57 |
| 3,876,198 | 4/1975 | Seligman | 272/142 X |
| 3,902,717 | 9/1975 | Kulkens | 272/142 X |
| 3,949,983 | 4/1976 | Tommasino | 272/57 |
| 4,072,309 | 2/1978 | Wilson | 272/136 |
| 4,098,502 | 7/1978 | Faust | 272/144 |
| 4,136,868 | 11/1979 | Hogue | 272/144 |
| 4,149,715 | 4/1979 | Kusmer | 272/136 X |
| 4,300,761 | 11/1981 | Howard | 272/134 |
| 4,316,609 | 2/1982 | Silberman | 272/118 |
| 4,319,747 | 3/1982 | Rogers | 272/123 X |
| 4,332,381 | 6/1982 | Lyons | 272/144 |
| 4,358,109 | 1/1982 | Schrems | 272/144 |
| 4,397,462 | 8/1983 | Wilmarth | 272/134 X |
| 4,465,274 | 8/1984 | Davenport | 272/134 X |
| 4,492,375 | 1/1985 | Connolly | 272/134 |
| 4,509,746 | 4/1985 | Mask | 272/134 |
| 4,582,320 | 4/1986 | Shaw | 272/134 X |

FOREIGN PATENT DOCUMENTS

| | | | |
|---|---|---|---|
| 2335022 | 1/1975 | Fed. Rep. of Germany | 272/134 |
| 2524329 | 10/1983 | France | 272/136 |
| 8005681 | 5/1982 | Netherlands | 272/134 |

*Primary Examiner*—Carl D. Friedman

[57] ABSTRACT

A portable self - contained exercise machine kit is compact and hand transportable. The kit when collapsed forms a rectangular configuration. The kit when assembled comprises a base member, a stanchion member and an exercise arm for performing upper and lower body exercises. The exercise arm is attached to the stanchion. An elongated handle is attached to the exercise arm and a bench member for attachment to the base is also provided in the kit.

15 Claims, 8 Drawing Figures

PORTABLE EXERCISE MACHINE

This application is a continuation-in-part of U.S. Ser. No. 669,680 filed Nov. 9, 1984, now U.S. Pat. No. 4,618,144 which is incorporated herein in its entirety.

BACKGROUND AND SUMMARY OF THE INVENTION

This invention relates to a physical exercise device and more particularly to a self-contained, hand-transportable exercise machine kit for use while traveling and in space limited environments such as an office or efficiency apartment.

Athletes and other performers and artists, such as dancers, must regularly perform various specific exercises to maintain proper body conditioning. While traveling, the performance of such exercises may be inconvenient or impossible since many of the exercise routines require exercise machines or devices which heretofore were large and cumbersome and required attachment to a building support. Additionally, the size and immobility of the prior exercise device restricted utilization in space limited environments, such as apartments, offices, etc.

Accordingly, it is an object of the present invention to provide a self-contained, hand-transportable portable exercise machine kit readily assemblable without tools into an exercise machine for performing a full range of upper and lower body exercises including those exercises commonly identified as the bench press exercise, the biceps curl-lateral pull exercise, the back-of-neck press exercise, the triceps pushdown exercise, the dorsi bar pulldown exercise, the military press exercise, the donkey press exercise, the vertical rowing exercise, the leg press, the leg extension, the squat exercises, and the butterfly exercise. Included in this object is the provision of an exercise device for performing such exercises without the use of weights.

Another object of the invention is to provide such an exercise machine kit which is compact and light for convenient hand transportability and space efficient stowage, e.g., being a dimensional size of approximately 36 inches×13 inches×7 inches and approximately 45 pounds in weight.

A further object is object is to provide such an exercise kit consisting of a minimum number of components.

A further object of the invention is to provide such an exercise kit which is readily assemblable without tools into a stable freestanding exercise machine.

It has been found that the foregoing and related objects and advantages can be obtained in a portable exercise having first and second base members detachably connectable to form a stable ground-engaging base. The first base member has a longitudinally extending section and a transverse The second base member has an elongated section generally parallel to said transverse section upon interconnection to said first base member by cooperating connection means. First and stanchion members have cooperating means for detachable interconnection to form an elongated support stanchion with the first stanchion member being detachably connectable to the base so as to extend vertically upward from the ground engaging base. An exercise arm assembly is detachably mountable to the support stanchion and has a pivotal exercise arm and mounting means for mounting to said support stanchion at a plurality of selected vertical positions. An elongated arm member is detachably connectable to the exercise arm. A bench member is mountable on the base. The first and second base members, the first and second stanchion members, and the handle member are substantially no longer than the bench member and are nested with the exercise arm assembly against the bench member to form a substantially rectangular compact configuration. A carrying bag is configured to snuggly receive and maintain the first and second base members, the first and second stanchion members, the handle member, the exercise arm assembly and the bench member in said compact configuration.

Other objects will be in part obvious and in part pointed out more in detail hereinafter.

DESCRIPTION OF THE PREFERRED EMBODIMENT

Figure 1:
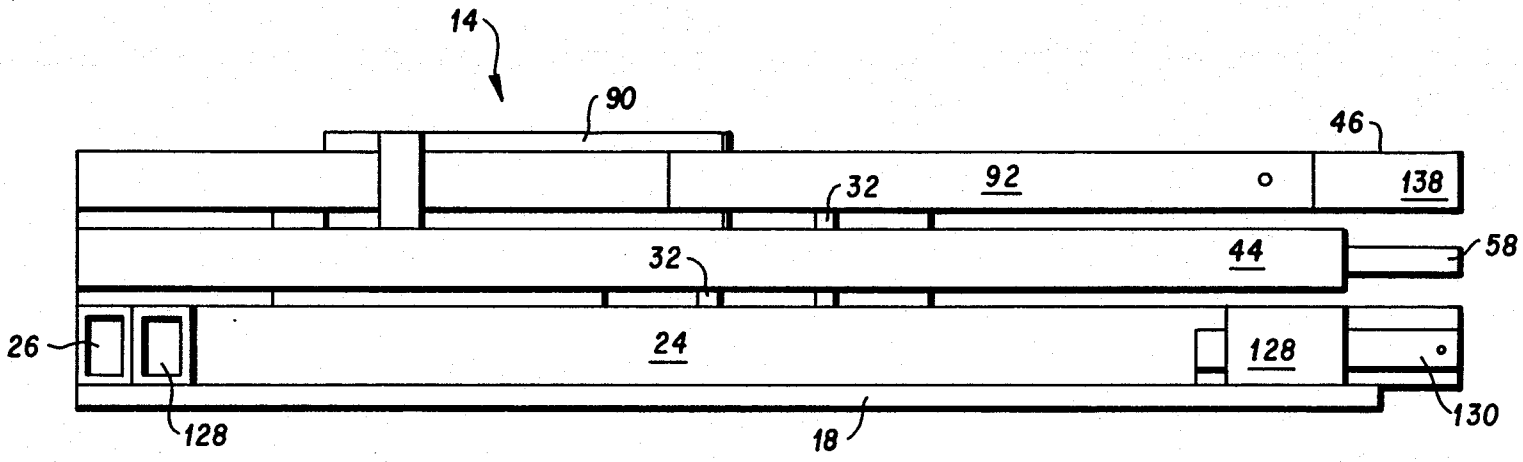
FIG. 1 is an elevational front view of the portable exercise kit of the present invention assembled in the transport/storage configuration.

Although specific forms of the present invention have been selected for illustration in the drawings, and the following description is drawn in specific terms for the purpose of describing these forms of the invention, the description is not intended to limit the scope of the invention which is defined in the appended claims.

Figure 2:
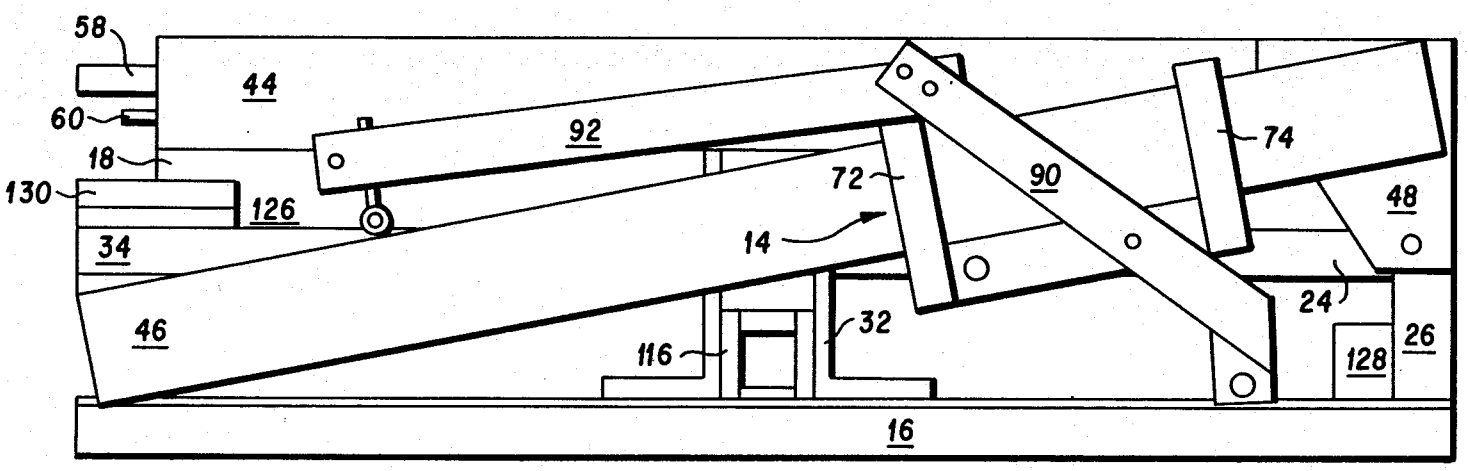
FIG. 2 is a plan view of the configuration as shown in FIG. 1.
Figure 5:
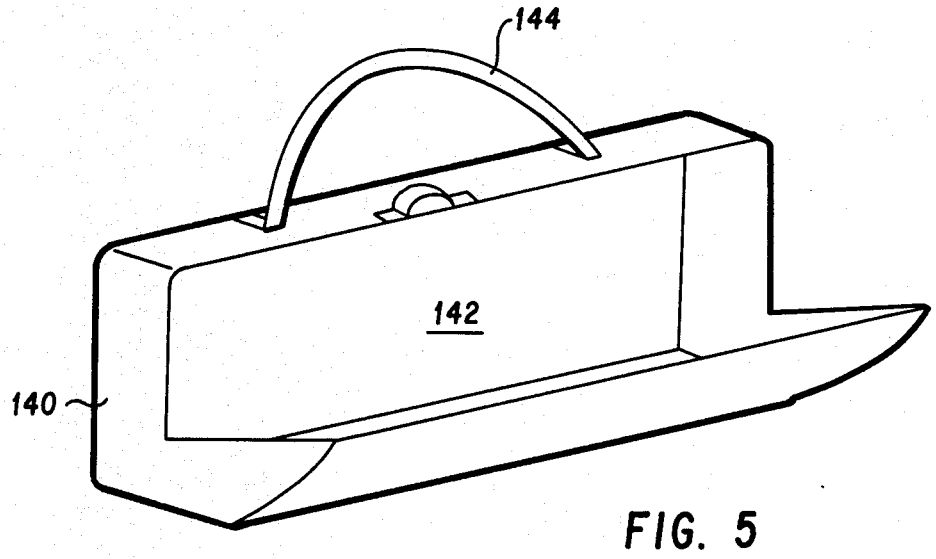
FIG. 5 is a perspective view of the carrying bag.
Figure 3:
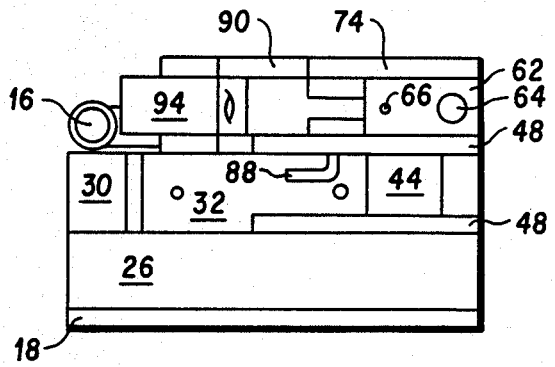
FIG. 3 is an end view of the configuration as shown in FIG. 1.
Figure 8:
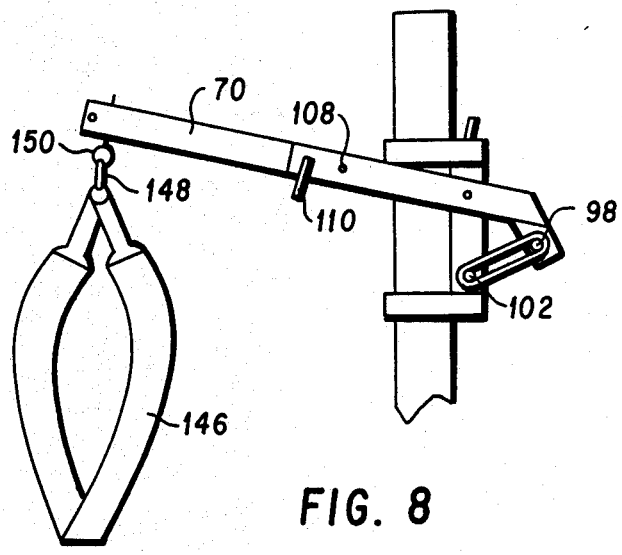
FIG. 8 is a partly broken away side view similar to FIG. 6 of the exercise machine in an alternate configuration.
Figure 6:
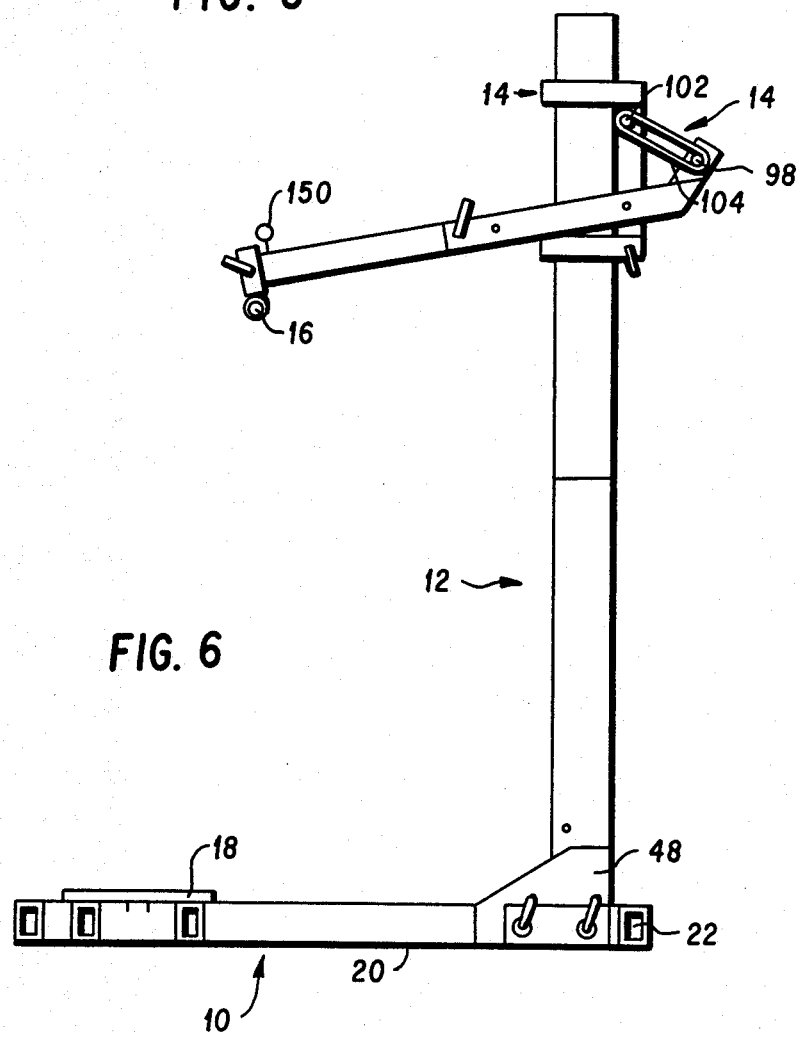
FIG. 6 is an elevational side view of the exercise machine in the assembled configuration.

Referring generally to the drawings, the exercise machine kit of the present invention is shown in a compact generally rectangular hexahedral configuration for transport or storage in FIGS. 1–3 and in assembled operational configurations in FIGS. 6 & 8 for upper and lower body exercises.

Figure 7:
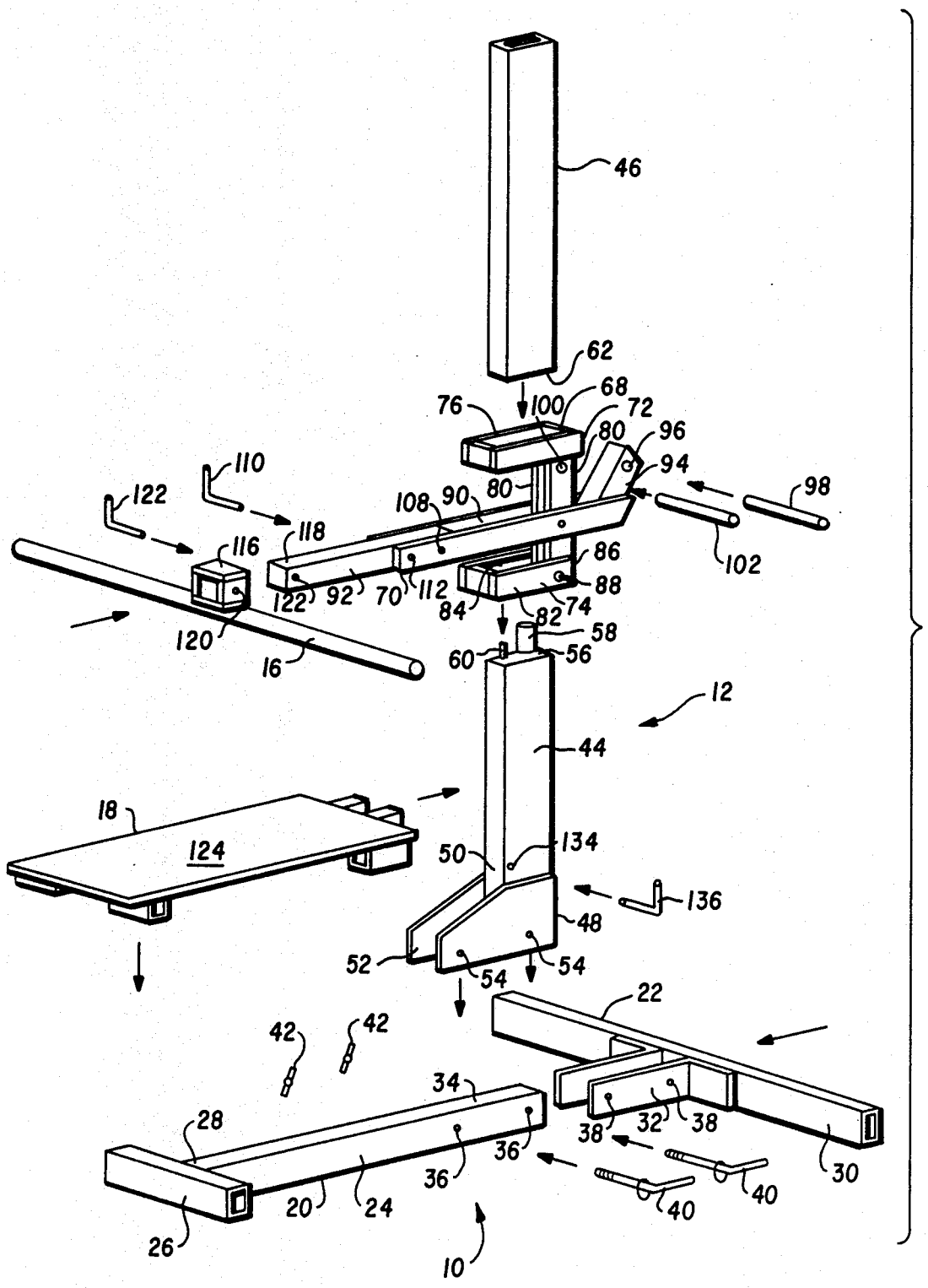
FIG. 7 is an exploded view of the assembled configuration of FIG. 6.

Referring to FIGS. 6 & 7, the portable exercise machine generally comprises a ground engaging base 10, an elongated support stanchion 12, an exercise arm assembly 14, a handle member 16, and a bench member 18.

The base 10 comprises first and second detachably connected base members 20,22. The base member 20 is T-shaped having an elongated central longitudinal section 24 with a transverse section 26 rigidly connected at one end 28 by welding or the like. The base member 22 has an elongated section 30 with a slotted connector 32 for connection to the end 34 of longitudinal section. The end 34 has fastener apertures 36 disposed for alignment with the fastener apertures 38 of connector 32. Hand operable bolts 40 and nuts 42 are utilized to securely interconnect the base members 20,22.

In assembly, the elongated section 30 is generally parallel to transverse section 26 and orthogonal to longitudinal section 24 to form a planar ground-engaging base. Preferably, the sections 24,26,30 are made from square-wall aluminum tubing and the connector 32 is constructed of two spaced aluminum angled bars welded to the elongated section 30 midway between the opposite ends thereof. In the illustrated embodiment, section 30 is 36 inches long, section 26 is 12 inches long, and base member 20 is 36 inches long.

The support stanchion 12 comprises a lower section 44 detachably connectable to an upper section 46. The lower section 44 has a slotted support connector 48 at its lower end 50 for detachable connection to the base 10. The connector 48 is constructed of spaced plates each welded to opposite sides of the stanchion section 44 to form a slot 52 therebetween dimensioned to slidably receive the end 34 of base section 24 in close-fitting relationship. The slot 33 of base connector 32 is dimensioned to slidably receive the stanchion connector 48 in close-fitting relationship. The stanchion connector 48 has apertures 56 positioned for alignment with base apertures 36,38 to receive the bolts 40 for a secure connection of base 10 and stanchion section 44.

The upper end 56 of lower stanchion section 44 has a pair of mounting pins 58,60 extending outwardly parallel to the longitudinal axis of stanchion section 44. The lower end 62 has a corresponding pair of bores 64,66 dimensioned to receive the mounting pins 58,60 respectively in friction-fit relationship to securely detachably connect stanchion members 44,46 in alignment to form the elongated support stanchion 12.

In assembly, the stanchion 12 extends vertically upward from the base 10. Preferably, the stanchion sections are made from aluminum rectangular wall tubing with stainless steel end caps for mounting the pins 58,60 and containing the bores 64,66 respectively. In the illustrated embodiment, the lower stanchion section 44 together with the connector 48 is approximately 34 inches long and the upper stanchion section 46 is approximately 36 inches long.

The exercise arm assembly 14 comprises a support bracket 68 for slidable mounting on the stanchion 12 and an exercise arm 70 pivotally mounted to the bracket 68. The bracket 68 has an upper rectangular shaped channel member 72 and a lower U-shaped channel member 74. The channel members 72,74 form channels or slots 76,78 respectively for slidably receiving the stanchion 12. Spaced vertical support bars 80 interconnect the channel members 72,74.

The U-shaped bracket 74 has opposing sides 82,84. The vertical support bars 80 are connected to the opposing sides 82,84 at the distal or open-ended end 86 of the U-shaped bracket 74. A bore extends through the side 82, the support bars 80, and the side 84. The portion of the bore through the side 84 is threaded for threaded engagement with the threaded end of clutch pin 88. Rotation of clutch pin 88 compresses the channel member 74 so as to squeeze the channel member against the stanchion and firmly lock the exercise arm assembly to the stanchion 12. As can be appreciated, this friction lock configuration allows infinite adjustment securement of the exercise arm assembly to the stanchion at any desired vertical position along the stanchion.

The exercise arm 70 has a slotted inner arm section 90 and an outer arm section 92. The slotted arm section 90 is pivotally mounted about the support bars 80 and has an outwardly extending projection 94 with a bore 96 for detachably mounting a loop mounting bar 98 in friction fit relationship. Similarly, the support bars 80 have a bore 100 for detachably mounting a loop mounting bar 102. A biasing loop 104 is mounted on the loop mounting bars 98,102 to bias the exercise arm against pivotal movement in one angular direction, e.g., clockwise as viewed in FIG. 6.

Figure 4:
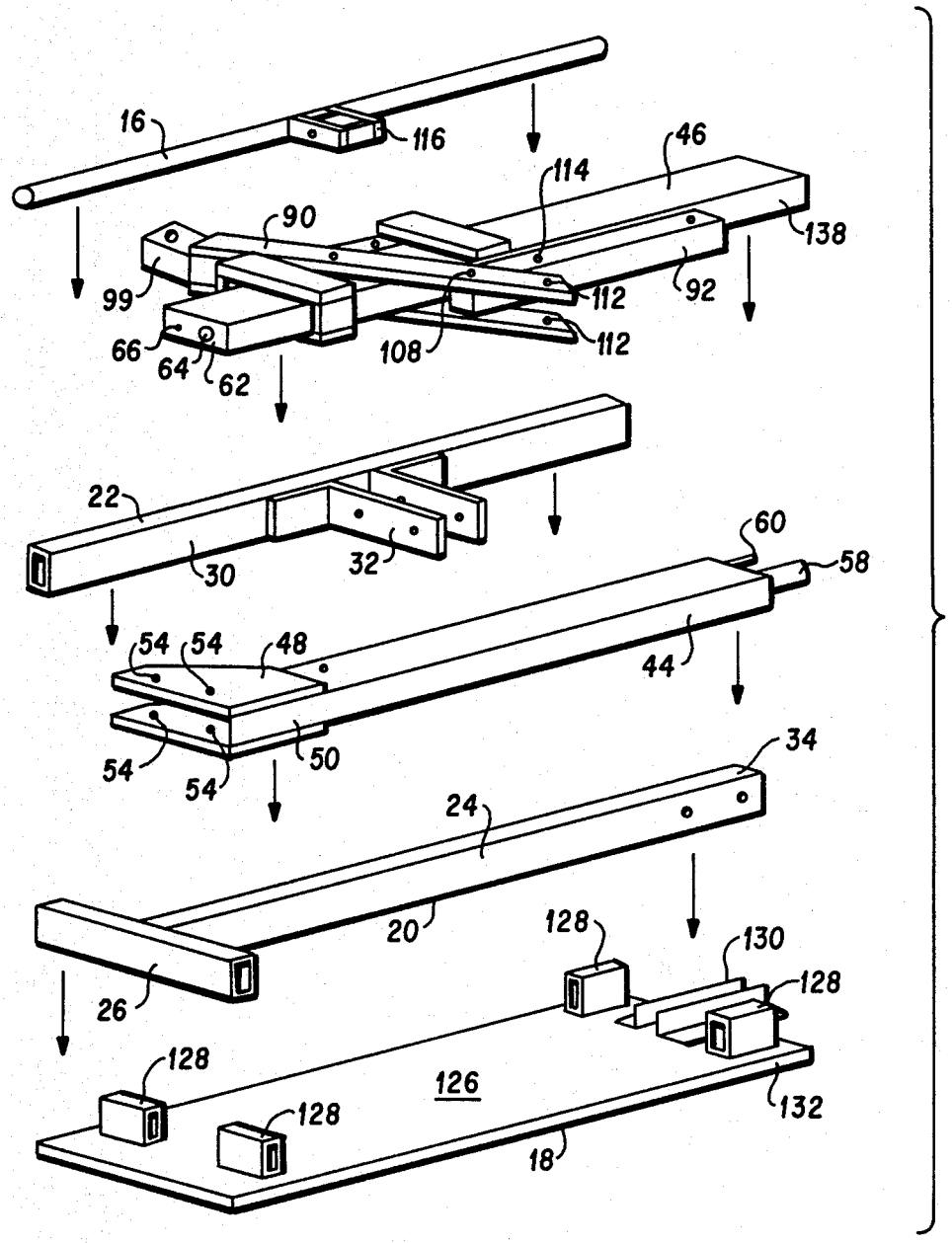
FIG. 4 is an exploded view of the configuration of FIGS. 1–3.

The outer arm section 92 is pivtoally mounted at one end 106 within the open end of slotted arm section 90 about a pivot pin 108. The arm section 92 is pivotal between an extended operational position in axial alignment with arm section 90 as shown in FIG. 7 and a folded position as shown in FIG. 4. The arm section 92 is lockable in the extended operational position by a locking pin 110 removably mounted in the aligned locking pin apertures 112,114 of the arm sections 90,92 respectively.

The handle 16 is an elongated tubular bar with a connector 116 for detachably mounting the handle 16 to the outer end 118 of the exercise arm section 92. The connector 116 is a square wall sleeve member configured to slidably receive the square wall outer end 118 of arm section 92 in close fitting relationship. The connector 116 is rigidly mounted to the handle 16 at the midpoint by welding or the like and has a locking pin aperture 120 disposed for alignment with a corresponding locking pin aperture 122 in the outer end 118. A slidable removable locking pin 122 securely locks the handle member 16 to the exercise arm 70 in the operational configuration.

Preferably, the handle 16 is constructed of cylindrical aluminum tube and the arm section 92 is square wall tube. In the illustrated embodiment, the handle is approximately 36 inches long, the arm section 90 is approximately 16 inches long and the arm section 92 is approximately 16 inches long.

The bend 18 is generally rectangular with upper and lower planar surfaces 124,126 resepctively. The bench is rigid with a soft, resilient outer covering on the upper surface to provide a comfortable surface for sitting and lying. Four support legs 128 are mounted on the lower surface 128 and are sufficiently high to permit the support legs 128 to support the bench 18 when it is positioned transverse across the base member 20 as shown if FIG. 6. A slotted connector 130 extends beyond the end 132 of the bench and has a locking pin aperture (not shown) for alignment with a locking pin aperture 134 in stanchion section 44 and reception of a locking pin 136 to detachably mount the bench 18 in an inclined position relative to the base 10.

The bench 18 is alternately mountable to the base 10 in three basic orientations depending on the desired exercise to be performed. In a first operational position as shown in FIG. 6, the longitudinal axis of the bench is transverse to the longitudinal axis of the base section 24 and the bench is supported on legs 128 as well as the bench section 24. In the second operational position, the longitudinal axis of the bench is parallel to the bench section 24 with the bench being supported on the base 10 and legs 128. In the third operational position, the bench is similarly aligned with the end 132 being elevated to incline the bench with the bench being supported by the connector 48 at one end and the base section 24 at the other end together with the lower pair of legs 128.

In the illustrated embodiment, the bench 18 is approximately 36 inches long and 13 inches wide. In assembly into the compact travel configuration, the first base member 20 is nested against the bench surface 126 with the transverse section 26 adjoining the outer sides of one pair of legs 128 and the end 34 being received in the slot of the connector 130. The end 34 may be secured to the connector 130 with a locking pin. The height of the legs 128 and the base 10 are approximately equal so the base member 20 and bench 18 form a substantially planar first layer.

The base section 22 is nested with the stanchion section 44 against the first layer formed by the bench 18 and base section 20. The longitudinal axis of elongated section 30 is generally parallel to the longitudinal axis of stanchion section 44 with the connector 32 extending toward the stanchion section 44 and the connector 48 extending toward the base section 22. In this relative orientation, the height of base section 22 and stanchion section 44 being approximately equal and the length of base section 22 and stanchion section 44 being approximately equal to that of bench 18, base section 22 and stanchion nest against the first layer to form a substantially planar second layer.

The exercise arm assembly 14 is mounted to upper stanchion section 46 at one end thereof. Pivotal arm section 92 is pivoted relative to arm section 90 so as to extend parallel to stanchion section 46 along its side edge 138 as shown in FIG. 4. The handle 16 is disposed generally parallel to stanchion section 46 with connector 116 extending toward stanchion section 46 and projection 94 extending toward handle 16.

In this relative orientation, the height of handle 16 and stanchion section 46 being approximately equal and the length of handle 16 and stanchion section 46 being approximately equal to that of bench 18, handle 16 and stanchion section 46 with exercise arm assembly 14 mounted thereon nest against the second layer to form a substantially planar third layer.

As seen from FIGS. 1–3, the bench 18, the base members 20,22, the stanchion sections 44,46, the handle 16 and the exercise arm assembly 14 nest together to form a generally rectangular hexahedral body. Miscellaneous mounting hardware and the biasing loop 104 may be placed in available spaces between components in the compact configuration.

The exercise machine kit is maintained in the compact travel configuration by a carrying bag 140. The carrying bag 140 is made of pliable canvas material and has an interior compartment 142 configured to receive and snuggly contain and maintain the exercise kit in the rectangular hexahedral compact configuration. A handle 144 is provided for carrying the kit. Canvas separators may be sewn into the interior compartment 142 to provide a thin protective layer between the adjoining layers to prevent scratching of the surfaces of the components. Individual container bags for the components may also be acceptable. Other forms of means for maintaining the kit in the compact configuration may also be utilized such as straps and rigid cases.

In the compact configuration, the exercise machine kit is approximately 36 inches long, 13 inches wide and 7 inches high and weighs approximately 45 pounds. As can be appreciated, the kit is easily hand transportable and requires little space for stowage.

To assemble the exercise machine kit into the operational configuration for performing a full range of upper and lower body exercises, the connector 48 is slidably mounted over the end 34 of base member 20 and connector 32 is slidable mounted about connector 48 such that the apertures 36,54,38 are aligned. Threaded fasteners 40,42 securely connect base member 20, base member 22, and stanchion section 44. Stanchion member 46 is pressed onto stanchion member 44 such that pins 58,60 are slidably inserted into bores 64,66 respectively to securely interconnect stanchion sections 44,46 to form a tall upstanding support stanchion for mounting the exercise arm assembly.

The exercise arm assembly is slidably mounted on the stanchion 12 with the stanchion being received in the bracket channels 76,78. The assembly is positioned an any desired vertical height along the stanchion 12 by the friction clutch pin 88. The loop mounting bars 98,102 are slidably mounted within the bores 96,80 respectively and the exercise loop 104 is mounted on the bars 98,102. The arm section 92 is pivoted into alignment with the arm section 90 and secured thereto with locking pin 110 inserted in aligned apertures 112,114 of arm sections 90,92 respectively.

The handle 16 is mounted to the end 118 of arm section 92 by locking pin 122 and the bench member is placed atop the base 10 in its desired position depending on the particular exercise routine. As can be appreciated, the exercise machine is easily and quickly assembled into the operational configuration without the need for hand tools. In the operational configuration, the base 10 provides a stable, free-standing support for a full range of upper and lower body exercises.

Referring to FIG. 6, the exercise arm assembly 14 is mounted to stanchion 12 such that the bar 102 is vertically above the bar 98. Consequently, the exercise arm is biased against upward pivotal movement, i.e., clockwise movement as seen in FIG. 6. The exercise arm assembly may be removed from the stanchion and inverted as shown in FIG. 8 so that the bar 98 is now vertically higher than the bar 102 thereby reversing the direction of angular bias. In the reversed position, the exercise arm is biased against downward pivotal movement, i.e., counterclockwise movement as seen in FIG. 8. In this manner, a full range of exercises is available by varying the orientation and vertical height of the exercise arm assembly.

Referring to FIG. 8, an alternate strap attachment 146 is attached to the exercise arm 70 in place of the handle 16 for the performance of butterfly type exercises. The strap 146 has a clip 148 for detachable connection to the eyelet 150 mounted on the end 118 of arm 70.

Accordingly, a self-contained hand-transportable portable exercise machine kit has been provided which is readily assemblable without tools into a freestanding exercise machine for the performance of a full range of upper and lower body exercises. As will be apparent to persons skilled in the art, various modifications and adaptations of the structure above described will become readily apparent without departure from the spirit and scope of the invention which is defined in the appended claims.

I claim:

1. A portable self-contained exercise machine kit in a compact, hand-transportable, generally rectangular configuration readily assemblable for performing upper and lower body exercises comprising a first base member having a longitudinal extending section and a transverse section, a second base member having an elongated section and being configured for detachable connection to said first base member to form a stable ground-engaging base for an exercise machine, said first and second base members having cooperating means for readily detachable interconnection such that said elongated section is disposed generally parallel to said transverse section of said first base member, first and second stanchion members having cooperating means for readily detachable interconnection to form an elongated support stanchion, said first stanchion member having means for detachable connection to said base so that said support stanchion extends vertically upward from said ground engaging base, an exercise arm assembly for performing upper and lower body exercises having a pivotal exercise arm detachably mountable to said support stanchion so as to extend over said base and means for detachably mounting said exercise arm to said support stanchion at a plurality of selected vertical positions, an elongated handle member having means for detachable connection to said exercise arm, a bench member for mounting on said base for sitting and lying position exercises, said first and second base members, said first and second stanchion members, and said handle member being substantially no longer than said bench member and being nested with said exercise arm assembly against said bench member to form a substantially rectangular compact configuration for transport and storage, and means for maintaining said first and second base members, said first and second stanchion members, said exercise arm assembly, said handle member, and said bench member in said compact configuration.

2. The device of claim 1 wherein said means for detachably mounting said exercise arm to said support stanchion comprises infinite adjustment securement means for selectively mounting said exercise arm at any desired vertical position on said stanchion.

3. The device of claim 1 wherein said means for detachably mounting said exercise arm to said support stanchion comprises a support bar slidably mountable to said stanchion and locking means for frictionally locking said bar to said stanchion for selective mounting of said exercise arm at any desired vertical position along said stanchion, said exercise arm being pivotally mounted to said support bar.

4. The device of claim 1 wherein said elongated section of said second base member is substantially the same length as said bench member and said first stanchion member is connectable to said base adjoining said elongated section with said elongated section being disposed transverse to said longitudinally extending section of said first base member.

5. The device of claim 4 wherein said first base member is T-shaped with said longitudinally extending section having first and second ends, said transverse section being connected at said first end and said elongated section of said second base member being detachably connectable to said second end.

6. The device of claim 1 wherein said bench member is rectangular having upper and lower generally planar surfaces and said first and second base members, said first and second stanchion members, said exercise arm assembly and said handle member are nested together against one of said surfaces of said bench member.

7. The device of claim 6 wherein said exercise arm assembly is detachably mounted to one of said first and second stanchion members.

8. The device of claim 7 wherein said first and second base members, said first and second stanchion members and said handle member are configured to nest together in substantially planar layers against said bench member.

9. The device of claim 8 wherein said first base member nests against one of said surfaces of said bench member to form a first generally planar layer, said second base member and one of said stanchion members nest together to form a second generally planar layer, and said handle member nests together with the other stanchion member to form a third generally planar layer with said second and third planar layers being nested against said first planar layer.

10. The device of claim 1 wherein said rectangular compact configuration is generally a rectangular hexahedral and said maintaining means is a rectangular hexahedral shaped carrying bag of pliable material having a handle and being configured to snugly contain said exercise kit.

11. The device of claim 1 wherein said rectangular compact configuration is generally a rectangular hexahedral being approximately 36 inches long, 13 inches wide and 7 inches high.

12. The device of claim 1 wherein said kit is handtransportable weighing approximately 45 pounds.

13. The device of claim 1 wherein said base member is selectively mountable atop said base member.

14. The device of claim 1 wherein said means for interconnecting said base members, said handle member and said exercise arm assembly, and said first stanchion member and said base comprise hand operable slidable locking pins and threaded fasteners being.

15. The device of claim 1 wherein said exercise arm assembly comprises biasing means for biasing said exercise arm against pivotal movement in a first angular direction and said means for detachably mounting said exercise arm to said support stanchion comprises means for alternately mounting said exercise arm to said stanchion in first and second orientations with said biasing means biasing said exercise arm against downward pivotal movement in one orientation and biasing said exercise arm against upward pivotal in the other orientation.

* * * * *